US008972063B2

(12) United States Patent
Kobayashi

(10) Patent No.: US 8,972,063 B2
(45) Date of Patent: Mar. 3, 2015

(54) FACILITY CONTROLLING SYSTEM AND METHOD

(75) Inventor: Hiroaki Kobayashi, Tokyo (JP)

(73) Assignee: Azbil Corporation, Tokyo (JP)

( * ) Notice: Subject to any disclaimer, the term of this patent is extended or adjusted under 35 U.S.C. 154(b) by 429 days.

(21) Appl. No.: 13/417,414

(22) Filed: Mar. 12, 2012

(65) Prior Publication Data

US 2012/0253522 A1 Oct. 4, 2012

(30) Foreign Application Priority Data

Mar. 30, 2011 (JP) ..... 2011-074870

(51) Int. Cl.
*G05B 13/00* (2006.01)
*F24F 11/00* (2006.01)

(52) U.S. Cl.
CPC ..... *F24F 11/0034* (2013.01); *F24F 2011/0075* (2013.01)
USPC ..... 700/276; 236/51; 315/292

(58) Field of Classification Search
USPC ..... 700/276; 236/51; 315/292
See application file for complete search history.

(56) References Cited

U.S. PATENT DOCUMENTS

2003/0074088 A1* 4/2003 Gonzales et al. ..... 700/19
2005/0040247 A1* 2/2005 Pouchak ..... 236/44 C
2005/0040248 A1* 2/2005 Wacker et al. ..... 236/51
2005/0040249 A1* 2/2005 Wacker et al. ..... 236/51
2005/0040250 A1* 2/2005 Wruck ..... 236/51
2006/0149395 A1* 7/2006 Archacki et al. ..... 700/19
2007/0114291 A1* 5/2007 Pouchak ..... 236/44 C
2008/0265799 A1* 10/2008 Sibert ..... 315/292

FOREIGN PATENT DOCUMENTS

JP 11-210284 A 8/1999
JP 2009-216283 9/2009
JP 2010-038375 2/2010

(Continued)

OTHER PUBLICATIONS

Korean Office Action, dated Apr. 24, 2013, which issued during the prosecution of Korean Patent Application No. 10-2012-0009670, which corresponds to the present application.

(Continued)

*Primary Examiner* — Robert Fennema
*Assistant Examiner* — Anthony Whittington
(74) *Attorney, Agent, or Firm* — Troutman Sanders LLP

(57) ABSTRACT

When, in an administering device, there has been an evaluation that a user is authorized to enter into any given controlled region, the occupant counts of a movement origin controlled region and of a movement destination controlled region are updated by an occupant count updating portion and stored in a storing portion, where the occupancy statuses specified by the individual occupant counts in the storing portion are reported to an air-conditioning controlling device. In the air-conditioning controlling device, electricity-saving control parameters corresponding to the applicable occupancy statuses are obtained from an electricity-saving control information storing portion by an air-conditioning controlling portion in response to occupancy statuses reported by the administering device, to cause air-conditioning equipment, corresponding to the applicable region, to perform electricity-saving operation based on the electricity-saving control parameters.

8 Claims, 9 Drawing Sheets

(56) References Cited

FOREIGN PATENT DOCUMENTS

| | | |
|---|---|---|
| JP | 2011-007359 A | 1/2011 |
| JP | 2011-047149 | 3/2011 |

OTHER PUBLICATIONS

Japanese Office Action dated Apr. 15, 2014, which issued during prosecution of Japanese Patent Application No. 2011-074870, which corresponds to the present application.

* cited by examiner

| Door ID | Movement Origin Controlled Region ID | Movement Destination Controlled Region ID |
|---|---|---|
| D1 | Common Portion | R1 |
| D2 | Common Portion | R2 |
| D3 | R2 | R3 |
| D4 | Common Portion | R4 |
| D5 | R2 | R5 |
| D6 | Common Portion | R6 |
| D7 | Common Portion | R7 |
| .... | ... | ... |

| User ID | Entry-Authorized Region ID |
|---|---|
| 100 | Common Portion, R1-R4 |
| 101 | Common Portion, R1-R4, R6 |
| 102 | Common Portion, R1-R7 |
| 103 | Common Portion, R1-R5, R7 |
| 104 | Common Portion, R4-R7 |
| 105 | Common Portion, R2-R6 |
| 106 | Common Portion, R1-R4, R6, R7 |
| ... | ... |

FIG. 5

| Controlled Region ID | Occupant Count |
|---|---|
| R1 | 10 |
| R2 | 5 |
| R3 | 2 |
| R4 | 3 |
| R5 | 0 |
| R6 | 5 |
| R7 | 2 |
| … | … |

FIG. 6

| Occupant Count | Occupancy Level |
|---|---|
| 0 to 5 | 1 |
| 6 to 10 | 2 |
| 11 to 15 | 3 |
| 16 to 20 | 4 |
| 21 to 25 | 5 |
| 25 to 30 | 6 |
| … | … |

FIG. 7

| Occupancy Level | Operation Interval (Min) | Stop Time (Min) | Upper Limit Temperature Setting (°C) | Lower Limit Temperature Setting (°C) |
|---|---|---|---|---|
| 1 | 40 | 20 | 25.5 | 22.5 |
| 2 | 40 | 18 | 25.0 | 23.0 |
| 3 | 40 | 16 | 24.5 | 23.5 |
| 4 | 40 | 14 | 24.0 | 24.0 |
| 5 | 40 | 12 | 23.5 | 24.5 |
| 6 | 40 | 10 | 23.0 | 25.0 |
| … | … | … | … | … |

FIG. 12

| Controlled Region ID | Air-Conditioned Region ID |
|---|---|
| R1 | K1 |
| R2 | |
| R3 | |
| R4 | K2 |
| R5 | |
| R6 | |
| R7 | |
| … | … |

FIG. 13

| Air-Conditioned Region ID | Occupant Count |
|---|---|
| K1 | 17 |
| K2 | 10 |
| … | … |

FACILITY CONTROLLING SYSTEM AND METHOD

CROSS REFERENCE TO RELATED APPLICATIONS

The present application claims priority under 35 U.S.C., §119 to Japanese Patent Application No. 2011-074870, filed Mar. 30, 2011, which is incorporated herein by reference.

FIELD OF TECHNOLOGY

The present invention relates to a facility controlling technology, and, specifically, relates to a facility controlling technology for performing air-conditioning control in accordance with the number of people present in an applicable area.

BACKGROUND

Conventionally, there have been proposals for technologies for performing air-conditioning control linked to the entrance/exit of individuals, controlled by entry/exit controlling devices (See, for example, Japanese Unexamined Patent Application Publication H11-210284). In this technology, an air-conditioning control panel is connected to a cooperative card reader and means for selecting a circuit for turning the air-conditioning ON/OFF are provided in the cooperative card reader, so that the air-conditioning is turned ON/OFF by the air-conditioning control panel through the operation of said means. With this structure, not only is an electric lock unlocked in the cooperative card reader at the time of an entry/exit operation, but also the air-conditioning of that circuit is turned ON/OFF as well, eliminating the need for manually turning the circuit ON/OFF with the air-conditioning control panel.

However, in such a technology the air-conditioning control is turned ON/OFF in cooperation with a person entering or exiting. Because of this, the air-conditioning control is performed identically whether there is a single individual or, for example, 10 people present in a given region. Consequently, there is a problem in that it is not possible to perform detailed energy-conserving operations in accordance with the number of people present in the region for air-conditioning equipment of a given region.

The present invention is to solve this type of problem, and the object thereof is to provide a facility controlling technology able to execute optimal electricity-saving operation in accordance with the number of people present in a region.

SUMMARY

In order to achieve such an object, the facility controlling system according to examples of the present invention include reader terminals provided at each controlled region within a facility, for sending an evaluation request requesting an entry-authorization evaluation for a user in regards to an applicable controlled region in response to an operation by the user; a controlling device for evaluating, in response to the evaluation request from the reader terminal, whether or not the user has entry authorization for the controlled region, based on evaluation information stored in advance in a storing portion; and an air-conditioning controlling device for controlling air-conditioning equipment for the air-conditioning of each controlled region; wherein the controlling device has an occupant count updating portion for updating, and storing in the storing portion, the occupant counts for a movement origin controlled region and a movement destination controlled region when, in response to the evaluation request by the reader terminal, there has been an evaluation that the user has entry authorization into the controlled region; and an occupancy status reporting portion for reporting, to the air-conditioning controlling device, an occupancy status for each individual controlled region specified by the individual occupant counts stored in the storing portion; and wherein the air-conditioning controlling device includes an electricity-saving control information storing portion for storing, in advance, a correspondence relationship between an occupancy status of a region and an electricity-saving control parameter used in air-conditioning control in that region at that time; and an air-conditioning controlling portion for receiving, from the electricity-saving control information storing portion, electricity-saving control parameters corresponding to the occupancy status, in accordance with an occupancy status reported by the controlling device, and for causing the air-conditioning equipment corresponding to the applicable region to perform electricity-saving operation based on the electricity-saving control parameters.

At this time, the air-conditioned region information that shows the correspondence relationship between the air-conditioned regions that are subject to air-conditioning by the air-conditioning equipment and the controlled regions that are included in the applicable air-conditioned regions, stored in advance in the storing portion, may be referenced by an occupant count updating portion, to specify the movement origin air-conditioned region and the movement destination air-conditioned region corresponding, respectively, to the movement origin controlled region and the movement destination controlled region, to update and store the occupant counts for each air-conditioned region corresponding to the applicable controlled regions, rather than for the controlled regions.

Moreover, in the occupant count updating portion, the occupant counts for the applicable movement origin air-conditioned region and movement destination air-conditioned region may be updated and stored into the storing portion only when the movement origin air-conditioned region is different from the movement destination air-conditioned region.

Furthermore, the applicable occupancy status may be reported by the occupancy status reporting portion to the air-conditioning controlling device at a point in time wherein a given occupancy status, of the occupancy statuses defined by the individual occupant counts that are stored in the storing portion, has changed in excess of a reference scope of change.

Furthermore, the electricity-saving control parameters for each occupant count, including an operation interval for when performing discontinuous operation of the air-conditioning equipment for air-conditioning control of the applicable region, and a stop time or driving time for the applicable air-conditioning equipment within the applicable operation interval may be stored by an electricity-saving control information storing portion.

Additionally, a facility controlling method according to the present invention is a facility controlling method used by a facility controlling system that includes reader terminals provided at each controlled region within a facility, for sending an evaluation request requesting an entry-authorization evaluation for a user in regards to an applicable controlled region in response to an operation by the user, a controlling device for evaluating, in response to the evaluation request from the reader terminal, whether or not the user has entry authorization for the controlled region, based on evaluation information stored in advance in a storing portion, and an air-conditioning controlling device for controlling air-conditioning equipment for the air-conditioning of each controlled region, where an occupant count updating step wherein the occupant count updating portion of the controlling device update and stores, in the storing portion, the occupant counts for a movement origin controlled region and a movement destination controlled region when, in response to the evaluation request by the reader terminal, there has been an evaluation that the user has entry authorization into the controlled region; an occupancy status reporting step wherein the an occupancy status reporting portion of the controlling device reports, to the air-conditioning controlling device, an occupancy status for each individual controlled region specified by the individual occupant counts stored in the storing portion; an electricity-saving control information storing step wherein an electricity-saving control information storing portion of the air-conditioning controlling device stores, in advance, a correspondence relationship between an occupancy status of a region and an electricity-saving control parameter used in air-conditioning control in that region at that time; and an air-conditioning controlling step wherein an air-conditioning controlling portion of the air conditioning controlling device receives, from the electricity-saving control information storing portion, electricity-saving control parameters corresponding to the occupancy status, in accordance with an occupancy status reported by the controlling device, and causes the air-conditioning equipment corresponding to the applicable region to perform electricity-saving operation based on the electricity-saving control parameters.

At this time, a step may be included as an occupant count updating step wherein the air-conditioned region information that shows the correspondence relationship between the air-conditioned regions that are subject to air-conditioning by the air-conditioning equipment and the controlled regions that are included in the applicable air-conditioned regions, stored in advance in the storing portion, is referenced, to specify the movement origin air-conditioned region and the movement destination air-conditioned region corresponding, respectively, to the movement origin controlled region and the movement destination controlled region, to update and store the occupant counts for each air-conditioned region corresponding to the applicable controlled regions, rather than for the controlled regions.

Moreover, a step may be included as an occupant count updating step wherein the occupant counts for the applicable movement origin air-conditioned region and movement destination air-conditioned region are updated and stored into the storing portion only when the movement origin air-conditioned region is different from the movement destination air-conditioned region.

Furthermore, a step may be included as an occupancy status reporting step wherein the applicable occupancy status is reported to the air-conditioning controlling device at a point in time wherein a given occupancy status, of the occupancy statuses defined by the individual occupant counts that are stored in the storing portion, has changed in excess of a reference scope of change.

Furthermore, a step may be included, as an electricity-saving control information storing step, wherein the electricity-saving control parameters for each occupant count, including an operation interval for when performing discontinuous operation of the air-conditioning equipment for air-conditioning control of the applicable region, and a stop time or driving time for the applicable air-conditioning equipment within the applicable operation interval are stored.

The examples of the present invention enable control of electricity-saving operations in air-conditioning equipment based on the number of occupants in each region, which is updated in real-time with each entry/exit authorization decision. Consequently, when compared to the case of turning air-conditioning control ON/OFF in cooperation with an individual entering or leaving, this enables the execution of optimal electricity-saving operations in accordance with the number of occupants in a region. Because of this, not only is it possible to obtain substantial electricity-saving results through reducing the operating time when there are few people, but also possible to maintain an excellent air-conditioning environment with high operating efficiency of the air-conditioning equipment when there are many people, which, as a result, enables optimal electricity-saving operation in accordance with the number of occupants of a region.

BRIEF DESCRIPTION OF THE DRAWINGS

FIG. 5 is an example of the structure of the occupancy information.

FIG. 6 is an example of the structure of the occupancy level information.

FIG. 7 an example of the structure of the electric power control information.

FIG. 12 is an example of the structure of the air-conditioned region information.

FIG. 13 is an example of the structure of the air-conditioned region information.

DETAILED DESCRIPTION

Forms for carrying out examples of the present invention are explained next in reference to the figures.

Figure 1:
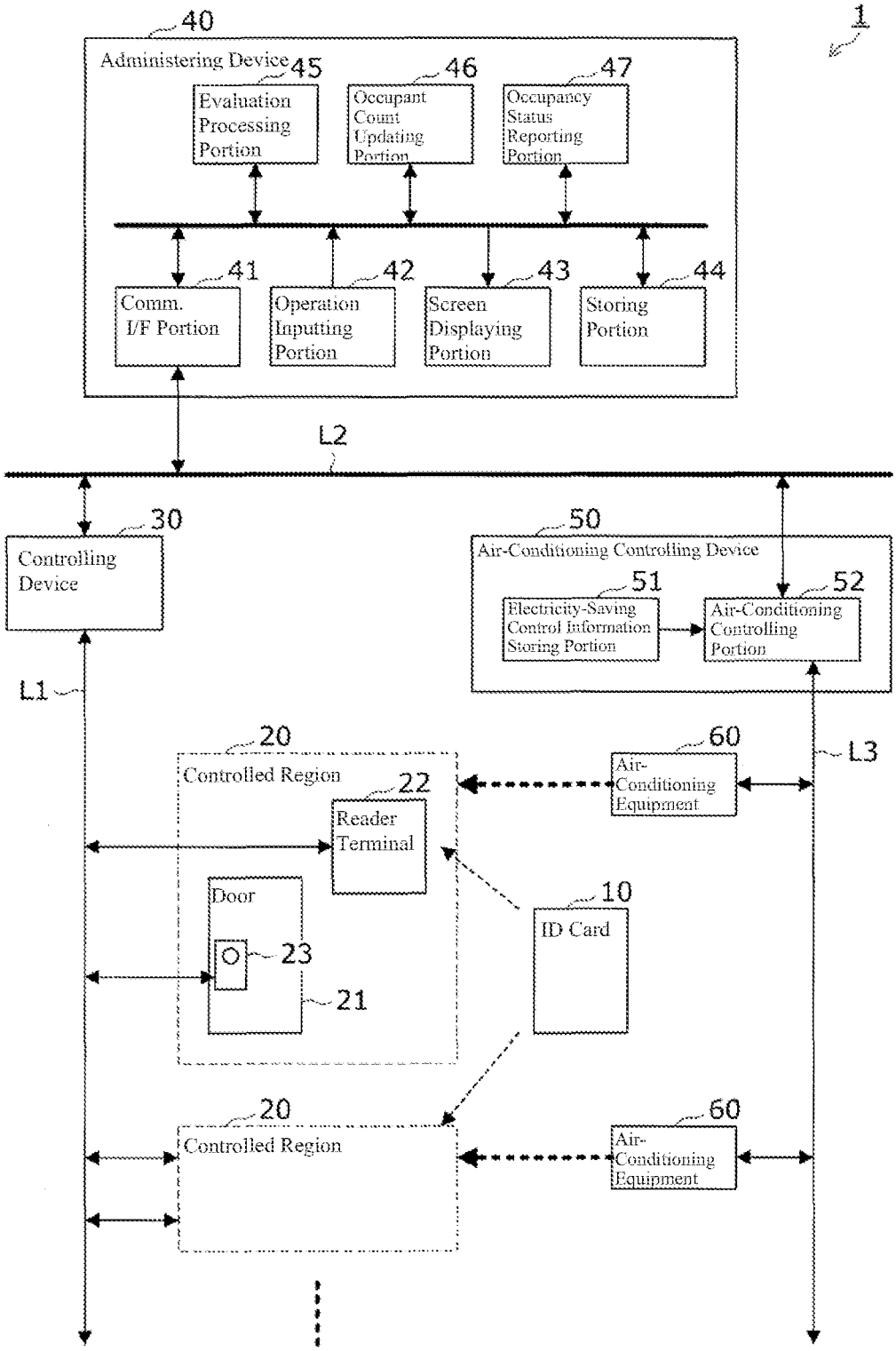
FIG. 1 is a block diagram illustrating a structure of a facility controlling system according to an example.

A facility controlling system 1 according to an example according to the present invention is explained in reference to FIG. 1. FIG. 1 is a block diagram illustrating a structure of a facility controlling system according to an example.

This facility controlling system has, in a administering device 40, a function for controlling the entrance/exit of individuals for each controlled region 20 provided in the facility, and for air-conditioning control in each controlled region 20, in cooperation with an air-conditioning controlling device 50, to execute the electricity-saving operation thereby.

The facility controlling system 1 includes: an ID card 10, a reader terminal 22, an electric lock 23, a controlling device 30, an administering device 40, an air-conditioning controlling device 50, and air-conditioning equipment 60.

The reader terminal 22 and the electric lock 23 that are provided for the door 21 of each controlled region 20 are connected to the controlling device 30 through a communication circuit L1 so as to be able to exchange data. Moreover, the controlling device 30 and an air-conditioning controlling device 50 are connected through a communication circuit L2 to an administering device 40 so as to enable data communications. At this time, depending on the scale of the facility controlling system 1, a plurality of controlling devices 30 and structures that are connected thereunder may be provided.

The ID card 10 has a mobile card for data processing, such as a memory card or an IC card, and has a function for recording user classification information, such as a user ID that is static for the user, as information required for evaluating whether or not the user who has the ID card is allowed to enter/exit.

The reader terminal 22 includes a card processing device such as a card reader, provided in parallel with each door 21 of a controlled region 20, and having a function for reading user classification information, such as a user ID, from the ID card 10 presented by the user, through inserting the ID card into a card slot (contact type) or through holding the ID card up to a card antenna (non-contact type), and a function for sending, through the communication circuit L1 to the controlling device 30, an evaluation request that includes the user classification information and a door ID that is unique to the applicable door 21 and that is set locally in advance.

The electric lock 23 has a function for performing unlocking/locking of a door 21 in accordance with an instruction for unlocking/locking from the controlling device 30, received through the communication circuit L1, and comprises an electrically actuated lock, and is provided for each door 21 of a controlled region 20. Note that the electric lock 23 is usually locked, and is unlocked for only a specific period of time when an unlock instruction arrives from the controlling device 30. Note that in the present example, the connection between the electric lock 23 and the controlling device 30 is not limited to being through a communication circuit, but rather there may be an electrical connection through an electric circuit.

The controlling device 30 includes a controlling device such as a controller, used in various types of control systems that perform overall control and monitoring of a facility and is provided with a function for receiving, through the communication circuit L1, evaluation requests from the reader terminals 22 that are provided at each of the controlled regions 20 and for reporting to the administering device 40 through the communication circuit L2, and a function for controlling the electric lock 23, which is provided at the door 21 of the corresponding controlled region 20, in response to an instruction from the administering device 40.

The administering device 40 is, overall, an information processing device such as a server device or a PC, and has a function for evaluating the entry/exit authorization of the user for the particular controlled region 20, in accordance with the evaluation request from the reader terminal 22 through the controlling device 30, to perform unlock control electric locks 23 that are provided in of the various controlled regions.

As the main functional portions, the administering device 40 is provided with a communication I/F portion 41, an operation inputting portion 42, a screen displaying portion 43, a storing portion 44, an evaluation processing portion 45, and occupant count updating portion 46, and an occupancy status reporting portion 47, where these functional portions are connected to each other through an internal bus so as to enable the exchange of data.

The communication I/F portion 41 has the function of performing data communication with the external devices, such as the controlling device 30 or an air-conditioning controlling device 50, through a communication circuit L2.

The operation inputting portion 42 is made from an operation inputting device, such as a keyboard or a mouse, and has a function for detecting operations by an operator and outputting them to various types of functional portions, such as the evaluation process portion 45.

The screen displaying portion 43 is made from a screen displaying device, such as an LCD or a PDP, and has a function for displaying on a screen various types of information outputted from various types of functional portions, such as the evaluation processing portion 45.

The storing portion 44 comprises a storage device such as a memory or a hard disk, and has a function for storing the various types of data and programs used in the processing operations by the administering device 40.

The storing portion 44 has, as its primary processing information, region information, evaluation information, occupancy information, and occupancy level information.

Figures 2, 3, 4:
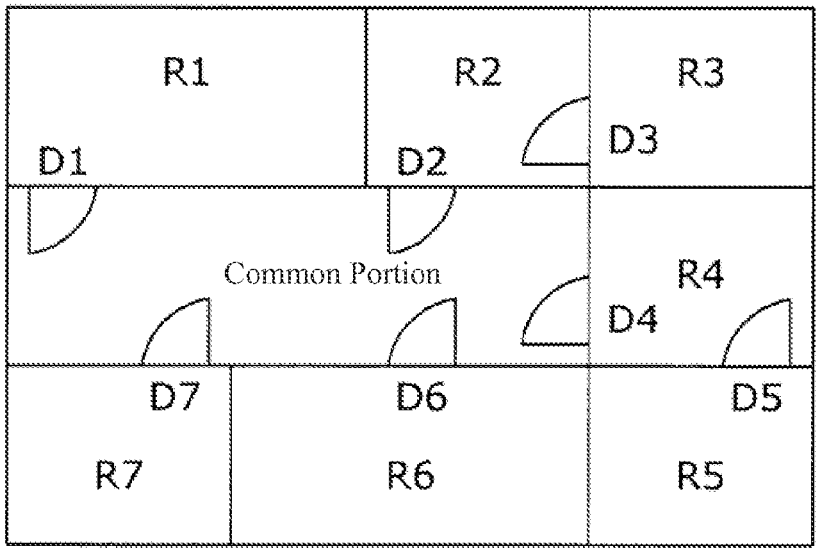
FIG. 2 is an example of the structure of the region information.
FIG. 3 is an example of the structure of a region.
FIG. 4 is an example of the structure of the evaluating information.

FIG. 2 is an example of the structure of the region information. Here a movement origin controlled region ID that indicates the movement origin controlled region when passing through a door 21, and a movement destination controlled region ID, which indicates the movement destination controlled region, are stored in combination for each door ID for identifying the doors 21 that are provided in each of the controlled regions 20. This region information is stored in advance in a storing portion 44 in accordance with the region structure in the facility to be administered.

FIG. 3 is an example of the structure of a region. Here there are seven controlled regions R1 through R7 that are arranged so as to surround a common portion, where each individual controlled region R1 through R7 is provided with a door D1 through D7. Of these doors D1 through D7, door D3 is a door that is provided between the controlled regions R2 through R3, where it is necessary to pass through the door D3 from the controlled region R2 in order to enter the controlled region R3. Similarly, door D5 is a door that is provided between the controlled regions R4 and R5, where it is necessary to pass through the door D5 from the controlled region R4 in order to enter into the controlled region R5. The other doors D1, D2, D4, D6, and D7 are provided so as to face the common portion.

FIG. 4 is an example of the structure of the evaluation information. Here a list of entry-authorized region IDs that indicates the regions into which the applicable user is authorized to enter is stored for each user ID for identifying the users. The evaluation information is stored in advance into the storing portion 44 based on the region structure in the facility that is subject to control, and the security level that is granted depending on the departmental membership and job description of the user.

FIG. 5 is an example of the structure of the occupancy information. Here the number of people occupying the controlled region, that is, the number of occupants, is stored for each controlled region ID for identifying each individual controlled region. The number of occupants is updated in accordance with entries and exits of individuals into/out of the controlled regions.

FIG. 6 is an example of the structure of the occupancy level information. Here a corresponding occupancy level is stored for each range of numbers of occupants. This occupancy level is an intermediating parameter in order to produce a correspondence between the number of occupants and the electricity-saving control parameters. A threshold value process is performed on the number of occupants based on this occupancy level information in the occupant count updating portion 46, and a report is sent to the air-conditioning controlling device 50 through specifying an occupancy level that indicates the occupancy statuses in each of the controlled regions.

The evaluation processing portion 45, has a function for producing an entry authorization decision in regards to the movement destination controlled region 20 that corresponds to the user in response to an evaluation request from a reader terminal 22 that has been received through a communication I/F portion 41 through the controlling device 30, by comparing a movement destination controlled region ID, obtained from the region information of the storing portion 44 based on the door ID that is specified in the evaluation request, and an entry-authorized region ID obtained from the evaluation information of the storing portion 44 based on the user ID specified in the evaluation request, in only the cases wherein the movement destination controlled region ID is included in the entry-authorized region IDs, and has a function for instructing an electric lock 23 of the door 21, through the controlling device 30 from the communication I/F portion 41, to open the lock. Note that while in the present form of embodiment a structure was explained wherein the evaluation processing portion 45 of the administering device 40 performed the evaluation process, instead the structure may be one wherein the controlling device 30 has a structural portion corresponding to the evaluation processing portion 40 and the storing portion 44 so that the controlling device 30 performs the aforementioned evaluation process and then report the evaluation result to the administering device 40.

The occupant count updating portion 46 has a function for obtaining a movement origin controlled region ID and a movement destination controlled region ID from the region information in the storing portion 44 based on the door ID specified in the evaluation request when there is an authorization evaluation for entering/exiting by the applicable user for the applicable controlled region 20 by the evaluation processing portion 45 in response to an evaluation request from a reader terminal 22, and a function for not only decrementing by one the occupant count for the movement origin controlled region ID, of the occupancy information in the storing portion 44, but also incrementing by one the occupant count for the movement destination controlled region ID, to update the occupant counts of these controlled regions and store them into the storing portion 44.

The occupancy status reporting portion 47 has a function for reading out the occupant counts for each of the controlled regions, stored in the occupancy information in the storing portion 44, a function for specifying an occupancy level, through performing a threshold value process on the occupant count, and a function for reporting periodically to the air-conditioning controlling device 50, through the communication circuit L2 from the communication I/F portion 41, the occupancy status, including a combination of the controlled region ID and the occupancy level for these controlled regions. At this time, in regards to the occupancy statuses, there may be a batch report for a plurality of controlled region IDs, or there may be individual reports for each individual controlled region ID.

In a typical air-conditioning controlling device, the degrees of opening of various types of valves may be adjusted at short intervals of a minute or less in the heating/cooling control, where, for the occupancy status as well, the reporting to the air-conditioning controlling device may be with a similar interval. Note that in some cases the occupant count can return to its original value after a short interval. For example, one may consider a case wherein an individual that has entered into a given controlled region may quickly complete his or her task within that region and then exit the region. In this case, if the occupancy status reporting interval is too short, then the switching to the electricity-saving operation can be performed for nothing, and thus the reporting of the occupancy status should be at intervals that anticipate some amount of time, Because of this, the occupancy status reporting interval may be set to an appropriate interval in consideration of the type of use of the region, the configuration of the region, and, additionally, the scale and structure of the air-conditioning equipment corresponding to the region.

In the administering device 40, the evaluation processing portion 45, the occupant count updating portion 46, and the occupancy status reporting portion 47 may be structured from a custom information processing circuit, or may be structured from a calculation processing portion wherein a CPU and a program operate cooperatively.

The air-conditioning controlling device 50 includes a controlling device, such as a controller, that is used in various types of control systems that perform administration and monitoring of the equipment as a whole, and has a function wherein, in response to the occupancy status reported by the administering device 40 through the communication circuit 12, electricity-saving control is performed in relation to an air-conditioning equipment 60 for a given region, connected through a communication line L3, based on an occupancy level of the region, reported in the occupancy status.

The air-conditioning controlling device 50 has, as it primary functional portions, an air-conditioning controlling portion 51 and an electricity-saving control information storing portion 52.

This air-conditioning controlling portion 51 has a function for obtaining, from the electricity-saving control information storing portion 52, electricity-saving control parameters corresponding to the occupancy level in response to an occupancy status reported by the administering device 40, and a function for energy-saving operation through intermittently driving the air-conditioning equipment in accordance with the applicable region based on the electricity-saving control parameters. This air-conditioning controlling portion 51 may be structured from a custom information processing circuit, or may be structured from a calculation processing portion wherein a CPU and a program operate cooperatively.

The energy-saving control information storing portion 52 is structured from a storage device such as a semiconductor memory or a hard disk, or the like, and has a function for storing the correspondence relationships between the occupancy levels of the regions and the electricity-saving control parameters used in air-conditioning control in the applicable regions.

In the present example, an electricity-saving operation for causing the air-conditioning equipment 60 to operate discontinuously is performed by the air-conditioning controlling portion 51 in regards to the air-conditioning equipment 60 for controlling the room temperature within any given region 20. Consequently, in the electricity-saving operation, the operation of the air-conditioning equipment 60 is stopped for a predetermined stop time in any given operation interval. The electricity that is consumed in the air-conditioning equipment 60 is saved thereby.

Moreover, at the point in time of the temperature rising or falling to a temperature setting in a state wherein the operation has been stopped by the air-conditioning controlling portion 51, the operation-stopped status is canceled early, even if the stop time has not expired, restarting the operation of the air-conditioning equipment 60. Doing so maintains a nice air-conditioning environment within the region, even during electricity-saving operations.

In such electricity-saving operations, several electricity-saving control parameters are required, where these electricity-saving control parameters vary depending on the occupancy status, depending on the number of occupants who occupy the region. In the present example, such energy-saving control parameters are specified in advance for each occupancy level, and stored in the energy-saving control information storing portion 52 as energy-saving control information.

FIG. 7 is an example of a structure of energy-saving control information. Here a combination of an operation interval, a stop time, an upper limit temperature setting, and a lower limit temperature setting is stored for each occupancy level.

Of this, the operation interval is the length of the interval over which there is discontinuous operation of the air-conditioning equipment, where the stop time is the time for which the operation of the air-conditioning equipment is stopped during the operation interval. The operation interval and the stop time are, of the energy-saving control parameters, essential parameters for determining the energy-saving efficiency in the air-conditioning equipment. Note that an operating time, over which the air-conditioning equipment is operated during the operation interval, may be used instead of a stop time, or an operating proportion or operation-stopped proportion, which indicate the ratio of the operating time and the stop time within an operation interval may be used.

Moreover, the upper limit temperature setting and the lower limit temperature setting are conditions for early cancellation of the stopping conditions for the air-conditioning equipment. This upper limit temperature setting and lower limit temperature setting are, among the energy-saving control parameters, additional parameters for ensuring the comfort of the air-conditioned environment, and are not critical parameters that are indispensable to the energy-saving operation. Of these, the upper limit temperature setting is used when performing a cooling operation by the air-conditioning equipment in the summertime, and the like, and the lower limit temperature setting is used when performing a heating operation using the air-conditioning equipment in the winter, and the like. Note that while a structure that uses an upper limit temperature setting (or a lower limit temperature setting) as a condition for early cancellation of the stop condition of the air-conditioning equipment is shown in the present example, the structure may also be provided with a lower limit temperature setting (or upper limit temperature setting) as a condition for early cancellation and restarting the operation of air-conditioning equipment that is in a stopped state. Moreover, the structure may be one wherein respective electricity-saving control information is provided separately for the springtime and for the autumn.

A facility controlling system 1 according to the present example is explained next.

Figure 8:
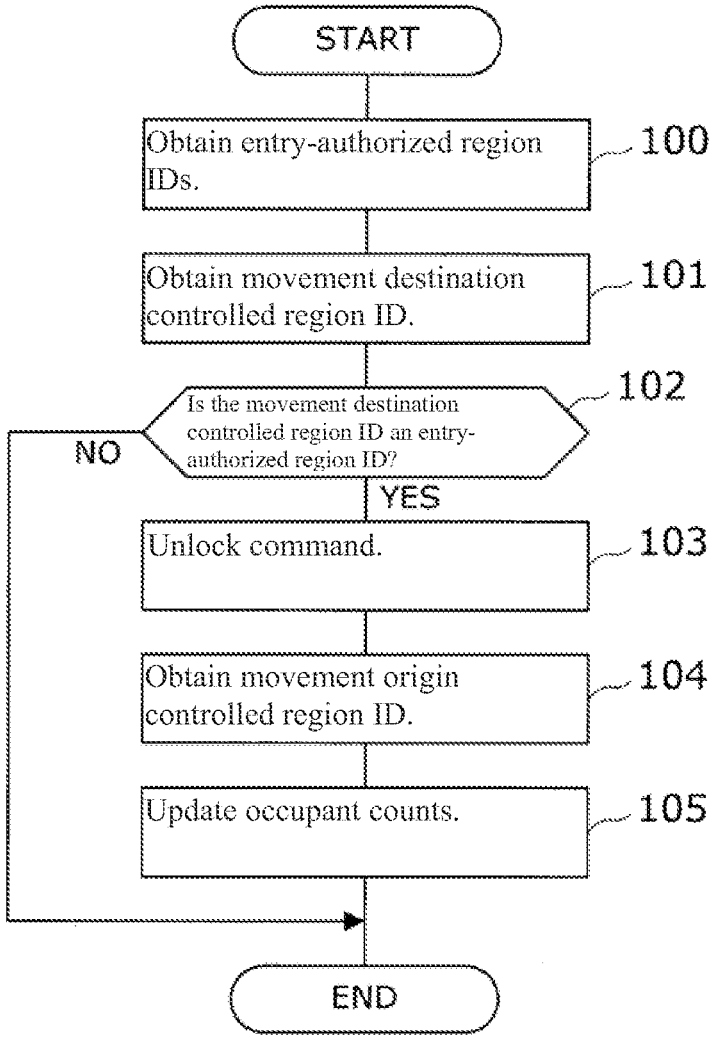
FIG. 8 is a flowchart illustrating the entry evaluating procedure in the administering device according to the example.

First the operation of the administering device 40 is explained in reference to FIG. 8, FIG. 8 is a flowchart illustrating the entry evaluating procedure in the administering device according to a first form of embodiment.

The administering device 40 executes the entry evaluating procedure of FIG. 8 in response to an evaluation request from a reader terminal 22.

The evaluation processing portion 45 first obtains the movement destination controlled region ID from the region information of the storing portion 44 based on the door ID specified by an evaluation request (Step 100), and then, similarly, obtains the entry-authorized region IDs from the evaluation information of the storing portion 44 based on the user ID specified in the evaluation request (Step 101).

Thereafter, the evaluation processing portion 45 compares the movement destination controlled region ID and the entry-authorized region IDs to check whether or not the movement destination controlled region ID is included in the entry-authorized region IDs (Step 102).

If the evaluation here is that entry is not authorized because the movement destination controlled region ID is not included in the entry-authorized region IDs (Step 102: NO), then the evaluation processing portion 45 terminates the series of entry evaluation processes.

On the other hand, if the movement destination controlled region ID is included in the entry-authorized region IDs, so that the evaluation is that entry is authorized (Step 102: YES), then the evaluation processing portion 45 commands the unlocking of the electric lock 23 of the applicable door 21, through the controlling device 30, from the communication I/F portion 41 (Step 103). In this way, the door 21 will be unlocked, enabling the user to move into the movement destination controlled region.

Moreover, when there has been an evaluation in the evaluation processing portion 45 that allows a user to enter into the applicable controlled region 20, then the occupant count updating portion 46 obtains the movement origin controlled region ID and the movement destination controlled region ID from the storing portion 44 based on the door ID specified in the evaluation request (Step 104).

Following this, the occupant count updating portion 46 decrements by one the number of occupants for the movement origin controlled region ID, and increments by one the number of occupants for the movement destination controlled region ID, in the occupancy information in the storing portion 44, to update the occupant counts for these regions and store them in the storing portion 44 (Step 105), to complete the series of entry evaluation processes.

Doing so causes the occupant counts in the movement origin controlled region and the movement destination controlled region to be updated in real-time in accordance with the entry authorization evaluation.

Figure 9:
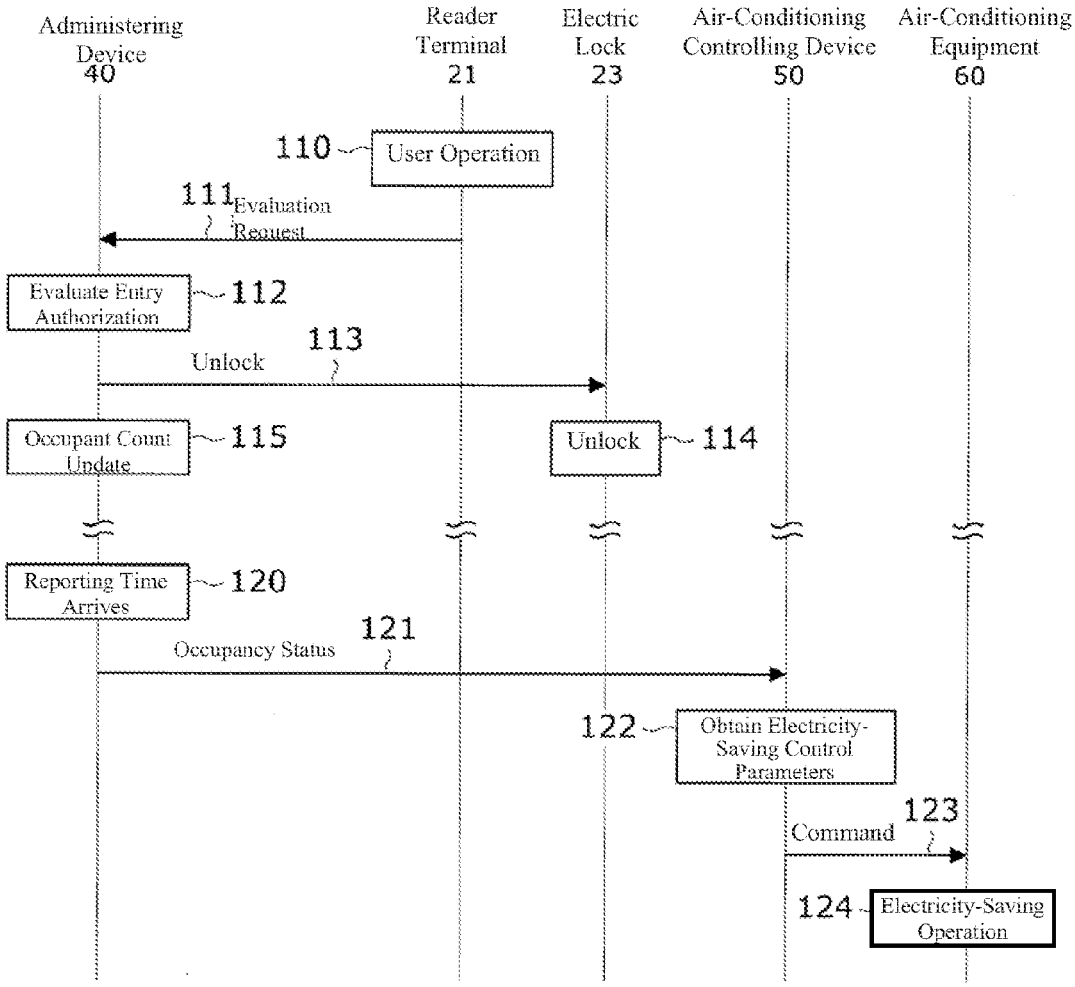
FIG. 9 is a sequence diagram illustrating the operation of the entirety of the facility controlling system.

The overall operation of the facility controlling system 1 can be explained next in reference to FIG. 9. FIG. 9 is a sequence diagram illustrating the operation of the entirety of the facility controlling system.

When there is a user operation using an ID card 10 in a reader terminal 22 (Step 110), then an evaluation request in accordance therewith is sent from the reader terminal 22 to the administering device 40 (Step 111).

In response to the evaluation request, the administering device 40, through the evaluation processing portion 45, evaluates whether or not the user has entry authorization, and if the evaluation is that entry is authorized (Step 112), the administering device 40 commands the electric lock 23 to unlock (Step 113). This unlocks the electric lock 23 (Step 114).

Moreover, the administering device 40, through the occupant count updating portion 46, updates the occupant counts for the applicable movement origin controlled region and movement destination controlled region (Step 115).

Thereafter, the administering device 40, through the occupancy status reporting portion 47, controls the occupancy status reporting times, and when a reporting time arrives (Step 120), reports, to the air-conditioning controlling device 50, an occupancy status that includes a combination of an occupancy level, specified by the number of occupants, stored in the occupancy information in the storing portion 44, and the controlled region ID (Step 121).

The air-conditioning controlling device 50, depending on the occupancy status from the administering device 40, obtains, from the electricity-saving control information storing portion 52, the electricity-saving control parameters corresponding to the occupancy level (Step 122), and sends, to the air-conditioning equipment 60, an electricity-saving operating instruction in accordance with the electricity-saving control parameters, through the air-conditioning controlling portion 51 (Step 123).

The air-conditioning equipment 60, in response to the electricity-saving operating instruction from the air-conditioning controlling device 50, performs electricity-saving operation through operating the air-conditioning equipment discontinuously (Step 124).

Figure 10:
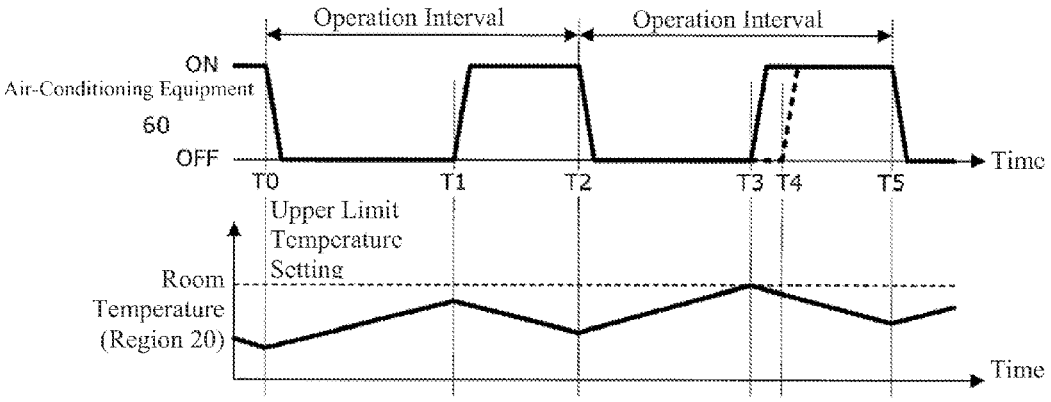
FIG. 10 is an example of electric power operations in air-conditioning equipment.

FIG. 10 is an example of electric power operations in air-conditioning equipment. The operating state (ON) and the stopped state (OFF) of the air-conditioning equipment 60, and the concomitant change in the room temperature of the region 20 are shown here.

In the operation interval beginning at Time T0, the operation of the air-conditioning equipment 60 is stopped beginning at Time T0 and the operation is restarted thereafter at Time T1. Even though the room temperature rises when in the stopped state, in this case it does not reach the upper limit temperature setting. The operation interval, the stop time, and the upper limit temperature setting are set by the energy-saving control parameters. On the other hand, in the operation interval beginning at Time T2, the operation of the air-conditioning equipment 60 is stopped beginning at Time T2, and the room temperature reaches the upper limit temperature setting at Time T3. As a result, the operation of the air-conditioning equipment 60 is restarted at Time T3, which is prior to Time T4, where the stop time would have elapsed.

In this way, in the administering device 40 in the present example, when, in response to an evaluation request from a reader terminal 22, there is an evaluation by the evaluation processing portion 45 that entry by the applicable user into the controlled region is authorized, the occupant counts for the movement origin controlled region and the movement destination controlled region are updated and stored in the storing portion by the occupant count updating portion 46, and occupancy statuses in accordance with the respective occupant counts, which are stored in the storing portion 44, are reported by the occupancy status reporting portion 47 periodically to the air-conditioning controlling device 50.

Moreover, in the air-conditioning controlling device 50, electricity-saving control parameters in accordance with the applicable occupancy statuses are obtained by the air-conditioning controlling portion 51 from the energy-saving control information storing portion 52 in accordance with the occupancy statuses that have been reported by the administering device 40, and the air-conditioning equipment 60 performs energy-saving operations corresponding to the applicable region based on the applicable energy-saving control parameters.

This makes it possible to control the energy-saving operations in the air-conditioning equipment based on the number of occupants in each of the regions, which are updated in real-time with each entrance authorization evaluation. Consequently, when compared to the case of turning air-conditioning control ON/OFF in cooperation with an individual entering or leaving, this enables the execution of optimal electricity-saving operations in accordance with the number of occupants in a region. Because of this, not only is it possible to obtain substantial electricity-saving results through reducing the operating time when there are few people, but also possible to maintain an excellent air-conditioning environment with high operating efficiency of the air-conditioning equipment when there are many people, which, as a result, enables optimal electricity-saving operation in accordance with the number of occupants of a region.

Note that while the explanation in the present example is for a case wherein the occupancy statuses of the individual controlled regions were reported periodically from the administering device 40 to the air-conditioning controlling device 50, there are no constraints here when it comes to the timing of reporting of the occupancy statuses. For example, the occupancy status regarding an applicable controlled region may be reported to the air-conditioning controlling device 50 by the occupancy status reporting portion 47 at the point in time that the number of occupants of any given controlled region is updated. Doing so makes it possible to report the occupancy status only when there has been a change in the number of occupants, making it necessary to perform updated electricity-saving control.

Moreover, while the explanation in the present example is of a case wherein occupancy statuses indicating the occupancy levels of each of the individual regions were reported by the administering device 40 to the air-conditioning controlling device 50, an occupant count may be reported instead of the occupancy level. In this case, the threshold value process regarding the occupant counts, performed by the occupancy status reporting portion 47 of the administering device 40, could instead be performed by the air-conditioning controlling portion S1 of the air-conditioning controlling device 50, and electricity-saving control parameters corresponding to the results of the threshold value processes may be obtained from the electricity-saving control information storing portion 52.

Moreover, conversely, instead of the occupancy level the electricity-saving control parameters may be reported as the occupancy status to the air-conditioning controlling device 50 from the administering device 40. In this case, the energy-saving control information of the energy-saving control information storing portion 52 may be stored in advance in the storing portion 44 of the administering device 40, the occupant count obtained from the occupancy information of the storing portion 44 by the occupancy status reporting portion 47 of the administering device 40 may be subjected to a threshold value process based on occupancy level information, and electricity-saving control parameters in accordance with the results of the threshold value process may be obtained from the electricity-saving control information.

A facility controlling system 1 according to another examples is explained next.

While in the above example is a case wherein there was a one-to-one correspondence between the controlled regions that are the control units for entry, and the air-conditioned regions that are the control units in air-conditioning control. In the present example the explanation is for a case wherein there is no one-to-one correspondence between the controlled regions and the air-conditioned regions.

Figure 11:
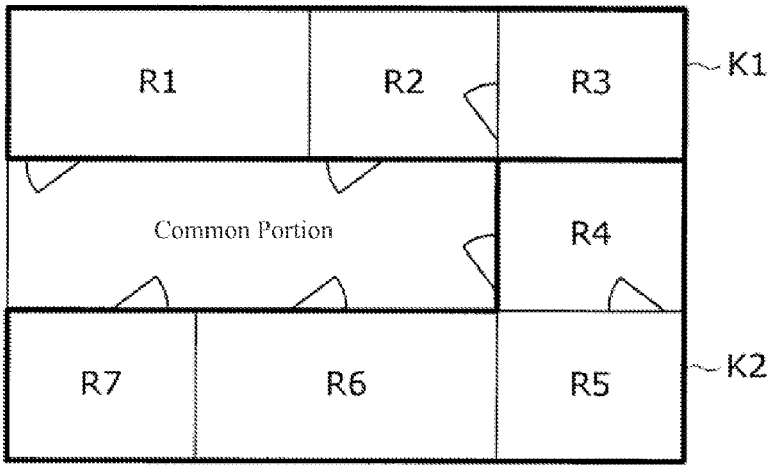
FIG. 11 is an example of the structure of a region.

FIG. 11 is an example of the structure of a region. Here, as with FIG. 3, seven controlled regions R1 through R7 are disposed encompassing a common portion. In the present example, of these controlled regions R1 through R7, controlled regions R1 through R3 have their air-conditioning controlled as a group by a single air-conditioning equipment 60, as a single air-conditioned region K1, and the controlled regions R4 through R7 have their air-conditioning controlled as a group by the identical air-conditioning equipment 60 as a single air-conditioned region K2.

The correspondence relationships between the controlled regions and the air-conditioned regions in this way are stored in advance as air-conditioned region information in the storing portion 44 of the administering device 40. FIG. 12 is an example of a structure of air-conditioned region information. Here an air-conditioned region ID that indicates the air-conditioned region corresponding to an applicable controlled region is stored for each controlled region ID, for identifying the controlled regions.

FIG. 13 is an example of the structure of the air-conditioning occupancy information. Here the total number of people occupying the controlled regions belonging to an air-conditioned region is stored as the occupant count for each individual air-conditioned region ID for identifying the individual air-conditioned regions. The occupant counts are updated with each entrance/exit of an individual into/out of the respective controlled regions belonging to the air-conditioned region.

In the present example, the occupant count updating portion 46 of the administering device 40 has a function for updating the occupant count for each air-conditioned region instead of each controlled region when updating the occupant counts. Specifically, it has a function for obtaining the movement origin controlled region ID and the movement destination controlled region ID based on the door ID specified in the evaluation request when, in response to an evaluation request from a reader terminal 22, there has been an evaluation, in the evaluation processing portion 45, that an applicable user is authorized to enter into the applicable controlled region 20, and a function for establishing the movement origin air-conditioned region ID and the movement destination air-conditioned region corresponding to the applicable movement origin controlled region ID and the applicable movement destination controlled region ID, through referencing the air-conditioned region information in the storing portion 44.

Moreover, the occupant count updating portion 46 has a function that compares the movement origin air-conditioned region ID and the movement destination air-conditioned region ID, and then, only if the two are different, decrements by one the occupant count of the movement origin air-conditioned region ID and increments by one the occupant count for the movement destination air-conditioned region ID in the air-conditioned occupancy information in the storing portion 44, to update and store, in the storing portion 44, the occupant counts for the air-conditioned regions.

The occupancy status reporting portion 47 of the administering device 40 has a function for reading out the occupant counts for each of the air-conditioned regions, stored in the air-conditioned occupancy information in the storing portion 44, and a function for reporting periodically to the air-conditioning controlling device 50, through the communication circuit L2 from the communication I/F portion 41, the occupancy status, including a combination of the air-conditioned controlled region ID and the occupant counts for these air-conditioned controlled regions.

Note that the other structures of the facility controlling system 1 according to the present example are identical to those in the example set forth above, and thus detailed explanations thereof are omitted.

Figure 14:
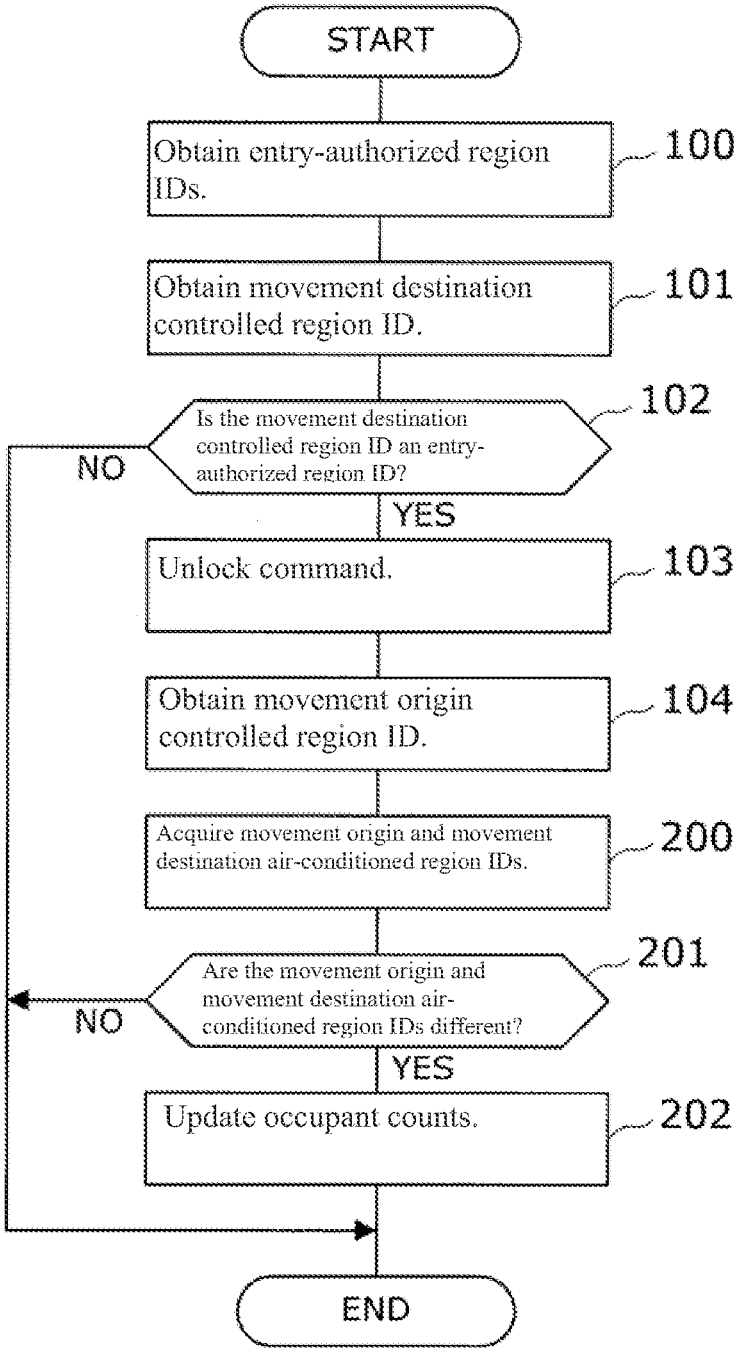
FIG. 14 is a flowchart illustrating the entry evaluating procedure in the controlling device according to another example.

The entry evaluating process by the administering device 40 is explained next in reference to FIG. 14 as the operation of the facility controlling system 1 according to the present example. FIG. 14 is a flowchart showing the entry evaluation process of the administering device according to the other example, where those parts that are identical or similar to those in FIG. 8, described above, are assigned identical codes.

The evaluation processing portion 45 of the administering device 40 executes the entry evaluating procedure of FIG. 8 in response to an evaluation request from a reader terminal 22.

The evaluation processing portion 45 first obtains the movement destination controlled region ID from the region information of the storing portion 44 based on the door ID specified by an evaluation request (Step 100), and then, similarly, obtains the entry-authorized region IDs from the evaluation information of the storing portion 44 based on the user ID specified in the evaluation request (Step 101).

Thereafter, the evaluation processing portion 45 compares the movement destination controlled region ID and the entry-authorized region IDs to check whether or not the movement destination controlled region ID is included in the entry-authorized region IDs (Step 102).

If the evaluation here is that entry is not authorized because the movement destination controlled region ID is not included in the entry-authorized region IDs (Step 102: NO), then the evaluation processing portion 45 terminates the series of entry evaluation processes.

On the other hand, if the movement destination controlled region ID is included in the entry-authorized region Ms, so that the evaluation is that entry is authorized (Step 102: YES), then the evaluation processing portion 45 commands the unlocking of the electric lock 23 of the applicable door 21, through the controlling device 30, from the communication portion 41 (Step 103). In this way, the door 21 will be unlocked, enabling the user to move into the movement destination controlled region.

Moreover, when there has been an evaluation in the evaluation processing portion 45 that allows a user to enter into the applicable controlled region 20, then the occupant count updating portion 46 obtains the movement origin controlled region ID and the movement destination controlled region ID from the storing portion 44 based on the door ID specified in the evaluation request (Step 104).

Following this, the occupant count updating portion 46 references the air-conditioned region information of the storing portion 44, to specify the movement origin air-conditioned region ID and movement destination air-conditioned region ID corresponding, respectively, to the movement origin controlled region ID and the movement destination controlled region ID (Step 200).

Here the occupant count updating portion 46 compares the movement origin air-conditioned region ID and the movement destination air-conditioned region ID (Step 201), and if the two match (Step 201: NO), determines that there is no need to update the occupant counts, and terminates the series of entry evaluation processes.

On the other hand, if the two are different (Step 201: YES), the occupant count updating portion 46 decrements by one the number of occupants for the movement origin air-conditioned region ID, and increments by one the number of occupants for the movement destination air-conditioned region ID, in the air-conditioned occupancy information in the storing portion 44, to update the occupant counts for these air-conditioned regions and store them in the storing portion 44 (Step 202), to complete the series of entry evaluation processes.

Doing so causes the occupant counts in the movement origin air-conditioned region and the movement destination air-conditioned region to be updated in real-time in accordance with the entry authorization evaluation.

Following this, in the same manner as in Step 120 and beyond in FIG. 9, described above, in the administering device 40, occupancy levels that correspond to the individual occupant counts that are read out from the air-conditioning occupancy information of the storing portion 44 are reported periodically to the air-conditioning controlling device 50 by the occupancy status reporting portion 47. Moreover, in the air-conditioning controlling device 50, the electricity-saving control parameters in the applicable air-conditioned region are specified by the air-conditioning controlling portion 51 in accordance with the report of the occupancy status by the administering device 40, and the air-conditioning equipment 60 executes the electricity-saving operation.

In this way, in the present example, the air-conditioned region information that shows the correspondence relationship between the air-conditioned regions that are subject to air-conditioning by the air-conditioning equipment and the controlled regions that are included in the applicable air-conditioned regions, stored in advance in the storing portion 44, is referenced by the occupant count updating portion 46 of the administering device 40, to specify the movement origin air-conditioned region and the movement destination air-conditioned region corresponding, respectively, to the movement origin controlled region and the movement destination controlled region, to update and store the occupant counts for each air-conditioned region corresponding to the applicable controlled regions, rather than for the controlled regions.

Doing so makes it possible to perform electricity-saving operations for each air-conditioned region, based on the occupant counts for the individual air-conditioned regions, which are updated in real-time with each entrance authorization evaluation, even when there is not a one-to-one correspondence between controlled regions and air-conditioned regions, as is seen in actual facilities.

Moreover, in the present example, the occupant count updating portion 46 of the administering device 40 references the air-conditioned region information in the storing portion 44 when it has been determined, in response to an evaluation request from a reader terminal 22, that the applicable user is authorized to enter into the controlled region, so that the occupant counts for the movement origin air-conditioned region and the movement destination air-conditioned region are updated and stored in the storing portion 44 only when the movement origin air-conditioned region is different from the movement destination air-conditioned region, through specifying the movement origin air-conditioned region and movement destination air-conditioned region corresponding, respectively, to the movement origin controlled region and the movement destination controlled region, enabling a reduction in wasted occupant count updating processes.

A facility controlling system 1 according to a further example of the invention is explained next.

In the above example, the explanation was for an example of a case wherein, when the occupancy status is reported from the administering device 40 to the air-conditioning controlling device 50, the occupancy statuses for the individual regions is reported periodically. In the present example, the explanation is for a case wherein the occupancy status of the applicable region is reported to the air-conditioning controlling device 50, even if prior to the arrival of the periodic reporting time if there has been some degree of change in the occupancy level of a given region in the occupancy information in the storing portion 44.

In the present example, the occupancy status reporting portion 47 of the administering device 40 has a function for ascertaining whether or not there has been a change in excess of a reference scope of change in the occupancy level of the individual controlled regions in the occupancy information in the storing portion 44, and a function for reporting, to the air-conditioning controlling device, the occupancy status pertaining to the applicable controlled region, prior to the arrival of the periodic reporting time, at the point in time that there has been a change of greater than the reference scope of change in the occupancy level of the given controlled range.

Note that the other structures of the facility controlling system 1 according to the present example are identical to those in the examples set forth above, and thus detailed explanations thereof are omitted.

Figure 15:
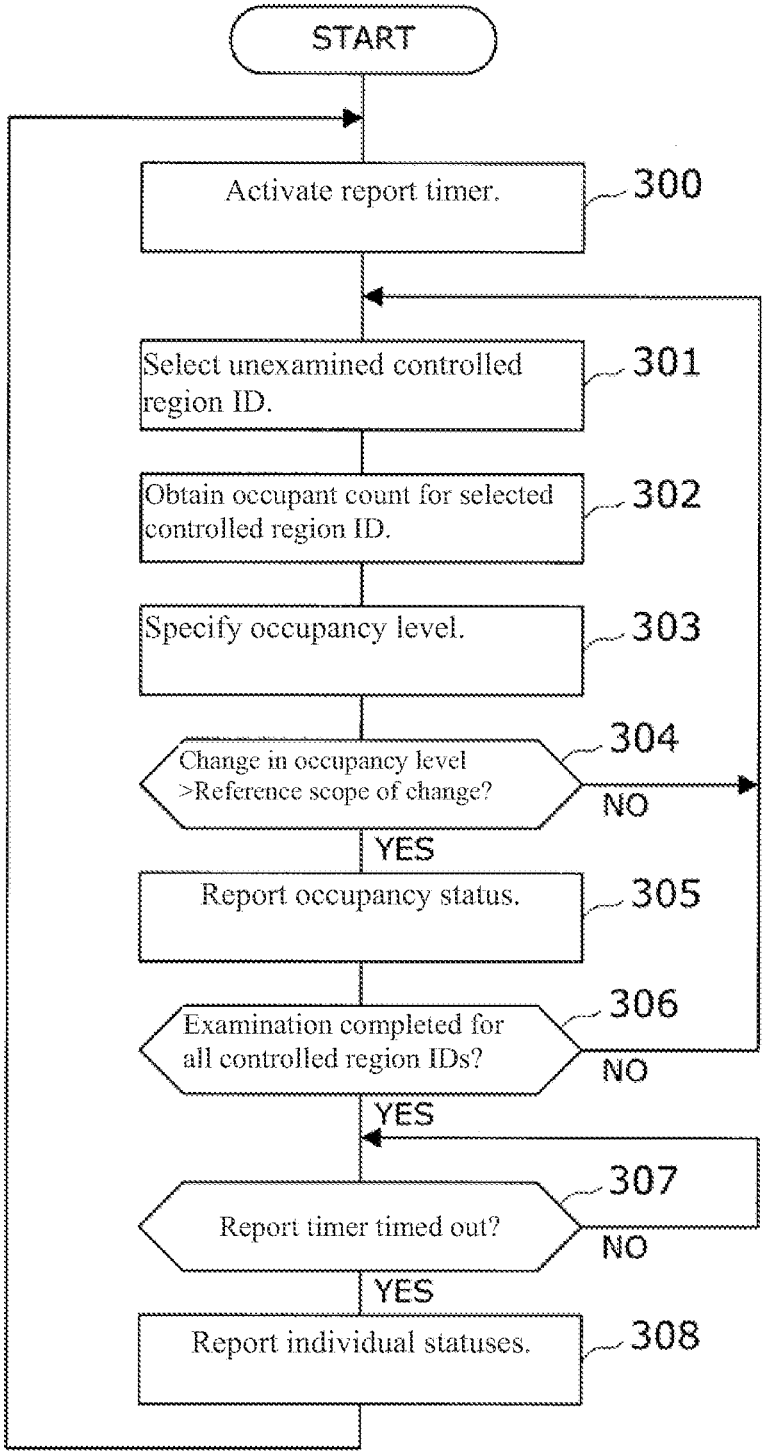
FIG. 15 is a flowchart illustrating the occupancy status reporting procedure in the controlling device according to the other example.

The occupancy status reporting process by the administering device 40 is explained next in reference to FIG. 15 as the operation of the facility controlling system 1 according to the present form of embodiment. FIG. 15 is a flowchart illustrating the occupancy status reporting process in the administering device according to an example.

The occupancy status reporting portion 47 of the administering device 40 constantly executes the occupancy status reporting process of FIG. 15.

The occupancy status reporting portion 47 first activates a report timer for timing the periodic occupancy status reporting times (Step 300). This report timer may, for example, utilize a timer function within the CPU.

Following this, the occupancy status reporting portion 47 selects one unexamined controlled region ID, for which the range of change in the occupant count has not been examined, from the occupancy information in the storing portion 44 (Step 301), and Obtains the occupant count corresponding to the selected controlled region ID (Step 302).

Following this, the occupancy status reporting portion 47 specifies the occupancy level corresponding to that occupant count, based on the occupancy level information of the storing portion 44 (Step 303), and compares the scope of change of the occupancy level for the selected controlled region ID to the reference scope of change set in advance in the storing portion 44 (Step 304). In regards to this scope of change in the occupancy level, it may be derived from the difference between the occupancy levels from the time of the previous examination to the time of the current examination, and the occupancy level at the time of the current examination may be stored temporarily in the storing portion 44.

If the scope of change in the occupancy level at this point is no higher than the reference scope of change (Step 304: NO), then processing returns to Step 301.

On the other hand, if the scope of change in the occupancy level exceeds the reference scope of change (Step 304: YES), then the occupancy status reporting portion 47 reports occupancy information, including the selected controlled region ID and the occupancy level thereof, to the air-conditioning controlling device 50 through a communication circuit L2 from the communication I/F portion 41 (Step 305).

Thereafter, the occupancy status reporting portion 47 checks whether or not the examinations of the occupancy levels have been completed for all of the controlled region IDs (Step 306), and if there is still an unexamined controlled region ID (Step 306: NO), processing returns to Step 307.

On the other hand, if the examinations have been completed for all of the controlled region IDs (Step 306: YES), then the occupancy status reporting portion 47 waits until the report timer times out (Step 307: NO).

Thereafter, when the report timer times out (Step 307: YES), the occupancy status reporting portion 47 reports the respective occupancy statuses to the air-conditioning, controlling device 50 for each individual controlled region ID stored in the occupancy information of the storing portion 44 (Step 308), and control returns to Step 300.

In this way, in the present example the occupancy status reporting portion 47 reports the applicable occupancy level to the air-conditioning controlling device 50 at the point in time wherein a given occupancy level changes in excess of a reference scope of change, in the occupancy levels specified by the individual occupant counts that are stored in the storing portion 44, making it possible to report immediately a new occupancy status to the air-conditioning controlling device 50, prior to the arrival of the periodic reporting time, when there is a large change in the occupancy level for any given controlled region.

As a result, when it is necessary to review the electricity-saving operations when there has been a large change in an occupancy level, the new occupancy status is reported to the air-conditioning controlling device 50, making it possible to start the updated electricity-saving operation automatically.

Note that when the reference scope of change is a single level, then the occupancy status will be reported with each change in the occupancy level, making it possible to omit reports of the occupancy statuses when there has been no change to the occupancy level.

Moreover, while the explanation in the present example is a case wherein the occupancy levels that are specified by the individual occupant counts that are stored in the storing portion 44 are examined periodically, there is no limitation thereto, but rather the applicable occupancy level may be examined at the point in time wherein there is a change in the occupant count for a given controlled region. Doing so makes it possible to report, without fail, the occupancy status to the air-conditioning controlling device 50 when, at the time of updating of the occupant counts, the update has caused a change wherein the scope of change in the new occupancy level exceeds the reference scope of change, thus enabling excellent responsiveness.

Note that white in the present example is a case of application to the above examples, there is no limitation thereto, but rather application in the same manner as described above, to obtain the same effects of operation, even wherein the occupant counts are controlled by the air-conditioned region unit.

While examples of the present invention are explained above, the present invention is not limited by the examples set forth above. The structures and details of the present invention may be modified in a variety of ways, as can be understood by those skilled in the art, within the scope of the present invention.

The invention claimed is:

1. A facility controlling system comprising:

at least one reader terminal provided at each of controlled regions within a facility, sending an evaluation request requesting, in response to an operation by a user, an entry-authorization evaluation whether the user has entry authorization for either entering or exiting the controlled region;

a controlling device evaluating, in response to the evaluation request from the reader terminal, whether or not the user has the entry authorization for the controlled region, based on evaluation information stored in advance in a storing portion of the controlling device; and an air-conditioning controlling device controlling air-conditioning equipment for the air-conditioning of each controlled region, wherein the controlling device comprises:

an occupant count updating portion updating occupant counts for a movement origin controlled region and a movement destination controlled region when, in response to the evaluation request by the reader terminal, the controlling device determines that the user has the entry authorization into the controlled region, and storing the updated occupant counts in the storing portion; and an occupancy status reporting portion reporting, to the air-conditioning controlling device, an occupancy status for the each of the controlled regions determined by the occupant count stored in the storing portion, wherein the air-conditioning controlling device comprises:

an electricity-saving control information storing portion storing, in advance, a correspondence relationship between an occupancy status of the each of the controlled regions and an electricity-saving control parameter used in air-conditioning control in that controlled region; and an air-conditioning controlling portion receiving, from the electricity-saving control information storing portion, the electricity-saving control parameter corresponding to the occupancy status reported by the controlling device, and causing the air-conditioning equipment corresponding to the each of the controlled region to perform electricity-saving operation based on the electricity-saving control parameter, and wherein the occupant count updating portion references air-conditioned region information, stored in advance in the storing portion, which indicates a correspondence relationship between an air-conditioned region, which is air-conditioned by the air-conditioning equipment, and the each of the controlled regions, which is included in the air-conditioned region, defines a movement origin air-conditioned region and a movement destination air-conditioned region, corresponding, respectively, to the movement origin controlled region and the movement destination controlled region, updates the occupant counts for air-conditioned regions corresponding to the controlled regions, instead of updating the occupant counts for the controlled regions, and stores the updated occupant counts in the storing portion.

2. The facility controlling system as set forth in claim 1, wherein:

the occupant count updating portion updates the occupant counts for the applicable movement origin air-conditioned region and movement destination air-conditioned region only when the movement origin air-conditioned region is different from the movement destination air-conditioned region, and stores the updated occupant counts into the storing portion.

3. The facility controlling system as set forth in claim 1, wherein:

the occupancy status reporting portion reports the applicable occupancy status to the air-conditioning controlling device at a point in time wherein a given occupancy status, of the occupancy statuses defined by the individual occupant counts that are stored in the storing portion, has changed in excess of a reference scope of change.

4. The facility controlling system as set forth in claim 1, wherein:

the electricity-saving control information storing portion stores electricity-saving control parameters for each occupant count, including an operation interval when performing discontinuous operation of the air-conditioning equipment for air-conditioning control of the applicable region, and a stop time or driving time for the applicable air-conditioning equipment within the applicable operation interval.

5. A facility controlling method used by a facility controlling system that comprises at least one reader terminal provided at each of controlled regions within a facility, sending an evaluation request requesting, in response to an operation by a user, an entry-authorization evaluation whether the user has entry authorization for either entering or exiting the controlled region, a controlling device evaluating, in response to the evaluation request from the reader terminal, whether or not the user has the entry authorization for the controlled region, based on evaluation information stored in advance in a storing portion of the controlling device, and an air-conditioning controlling device controlling air-conditioning equipment for the air-conditioning of each controlled region, the facility controlling method comprising:

an occupant count updating step updating, by an occupant count updating portion of the controlling device, occupant counts for a movement origin controlled region and a movement destination controlled region when, in response to the evaluation request by the reader terminal, the controlling device determines that the user has the entry authorization into the controlled region, and storing the updated occupant counts in the storing portion;

an occupancy status reporting step reporting, by an occupancy status reporting portion of the controlling device, to the air-conditioning controlling device, an occupancy status for the each of the controlled regions determined by the occupant count stored in the storing portion;

an electricity-saving control information storing step storing in advance, by an electricity-saving control information storing portion of the air-conditioning controlling device, a correspondence relationship between an occupancy status of the each of the controlled regions and an electricity-saving control parameter used in air-conditioning control in that controlled region; and an air-conditioning controlling step receiving by an air-conditioning controlling portion of the air conditioning controlling device, from the electricity-saving control information storing portion, the electricity-saving control parameter corresponding to the occupancy status reported by the controlling device, and causing the air-conditioning equipment corresponding to the each of the controlled region to perform electricity-saving operation based on the electricity-saving control parameters, wherein the occupant count updating step includes a referencing step of referencing air-conditioned region information, stored in advance in the storing portion, which indicates a correspondence relationship between an air-conditioned region, which is air-conditioned by the air-conditioning equipment, and the each of the controlled regions, which is included in the air-conditioned region, defining a movement origin air-conditioned region and a movement destination air-conditioned region, corresponding, respectively, to the movement origin controlled region and the movement destination controlled region, updating the occupant counts for air-conditioned regions corresponding to the controlled regions, instead of updating the occupant counts for the controlled regions, and storing the updated occupant counts in the storing portion.

6. The facility controlling method as set forth in claim 5, wherein:

the occupant count updating step includes a step updating the occupant counts for the applicable movement origin air-conditioned region and movement destination air-conditioned region only when the movement origin air-conditioned region is different from the movement destination air-conditioned region, and storing into the storing portion.

7. The facility controlling method as set forth in claim 5, wherein:

the occupancy status reporting step includes a step of reporting the applicable occupancy status to the air-conditioning controlling device at a point in time wherein a given occupancy status, of the occupancy statuses defined by the individual occupant counts that are stored in the storing portion, has changed in excess of a reference scope of change.

8. The facility controlling method as set forth in claim 5, wherein:

the electricity-saving control information storing step includes a step of storing electricity-saving control parameters for each occupant count, including an operation interval for when performing discontinuous operation of the air-conditioning equipment for air-conditioning control of the applicable region, and a stop time or driving time for the applicable air-conditioning equipment within the applicable operation interval.

* * * * *